US009291000B2

(12) United States Patent
Zhang et al.

(10) Patent No.: US 9,291,000 B2
(45) Date of Patent: Mar. 22, 2016

(54) ROLLING CUTTER WITH IMPROVED ROLLING EFFICIENCY

(71) Applicant: SMITH INTERNATIONAL, INC., Houston, TX (US)

(72) Inventors: Youhe Zhang, Spring, TX (US); Yuelin Shen, Spring, TX (US); Yuri Burhan, Spring, TX (US); Kjell Haugvaldstad, Vanvikan (NO)

(73) Assignee: Smith International, Inc., Houston, TX (US)

( * ) Notice: Subject to any disclaimer, the term of this patent is extended or adjusted under 35 U.S.C. 154(b) by 579 days.

(21) Appl. No.: 13/677,105

(22) Filed: Nov. 14, 2012

(65) Prior Publication Data

US 2013/0146367 A1 Jun. 13, 2013

Related U.S. Application Data

(60) Provisional application No. 61/559,423, filed on Nov. 14, 2011.

(51) Int. Cl.

| | |
|---|---|
| ***E21B 10/627*** | (2006.01) |
| ***E21B 10/50*** | (2006.01) |
| ***E21B 10/08*** | (2006.01) |
| ***E21B 10/62*** | (2006.01) |
| ***E21B 10/633*** | (2006.01) |
| ***E21B 10/55*** | (2006.01) |

(52) U.S. Cl.

CPC ..... *E21B 10/50* (2013.01); *E21B 10/08* (2013.01); *E21B 10/55* (2013.01); *E21B 10/62* (2013.01); *E21B 10/627* (2013.01); *E21B 10/633* (2013.01)

(58) Field of Classification Search

CPC ..... E21B 10/633; E21B 10/627; E21B 10/62

See application file for complete search history.

(56) References Cited

U.S. PATENT DOCUMENTS

| | | | | | |
|---|---|---|---|---|---|
| 1,790,613 | A | * | 1/1931 | Gildersleeve et al. | 175/348 |
| 1,973,975 | A | * | 9/1934 | Carlson | 175/354 |
| 2,227,209 | A | * | 12/1940 | Zublin | 175/339 |
| 2,667,334 | A | * | 1/1954 | Ortloff | 175/405.1 |
| 3,307,645 | A | * | 3/1967 | Hildebrandt | 175/372 |
| 4,104,344 | A | | 8/1978 | Pope et al. | |
| 4,288,248 | A | | 9/1981 | Bovenkerk et al. | |
| 4,553,615 | A | * | 11/1985 | Grainger | 175/432 |
| 4,960,643 | A | * | 10/1990 | Lemelson | 428/408 |
| 5,127,923 | A | | 7/1992 | Bunting et al. | |
| 5,352,045 | A | * | 10/1994 | Bennett et al. | 384/96 |
| 7,703,559 | B2 | | 4/2010 | Shen et al. | |
| 8,727,043 | B2 | | 5/2014 | Zhang et al. | |
| 2007/0278017 | A1 | * | 12/2007 | Shen et al. | 175/426 |
| 2010/0108403 | A1 | | 5/2010 | Keshavan | |

(Continued)

FOREIGN PATENT DOCUMENTS

| | | | |
|---|---|---|---|
| GB | 2493322 | A | 1/2013 |
| WO | 2010144837 | A2 | 12/2010 |

(Continued)

*Primary Examiner* — Giovanna C Wright

(57) ABSTRACT

A cutting structure may include an outer support element; and an inner rotatable cutting element comprising a cutting surface at its upper end; wherein the inner rotatable cutting element comprises at least one line contact along a circumferential side surface thereof and/or at least one point contact at a bottom face thereof.

24 Claims, 9 Drawing Sheets

(56) References Cited

U.S. PATENT DOCUMENTS

2011/0284293 A1 11/2011 Shen et al.
2011/0297454 A1 12/2011 Shen et al.
2012/0273280 A1 11/2012 Zhang et al.
2012/0273281 A1 11/2012 Burhan et al.
2012/0279784 A1* 11/2012 Harvey et al. ..... 175/265
2013/0140094 A1 6/2013 Burhan et al.

FOREIGN PATENT DOCUMENTS

WO 2011146736 A2 11/2011
WO 2011153439 A1 12/2011

* cited by examiner

ROLLING CUTTER WITH IMPROVED ROLLING EFFICIENCY

CROSS-REFERENCE TO RELATED APPLICATIONS

This patent application claims priority to U.S. Provisional Patent Application No. 61/559,423, filed on Nov. 14, 2011, which is incorporated herein by reference in its entirety.

BACKGROUND

1. Technical Field

Embodiments disclosed herein relate generally to polycrystalline diamond compact cutters and bits or other cutting tools incorporating the same. More particularly, embodiments disclosed herein relate to rolling cutters having reduced contact surfaces and bits or other cutting tools incorporating the same.

2. Background Art

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical application, a compact of polycrystalline diamond (PCD) (or other ultrahard material) is bonded to a substrate material, which is typically a sintered metal-carbide to form a cutting structure. PCD comprises a polycrystalline mass of diamonds (typically synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter is conventionally formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate often comprises a metal-carbide composite material, such as tungsten carbide-cobalt. The deposited diamond layer is often referred to as the "diamond table" or "abrasive layer."

An example of a prior art PDC bit having a plurality of cutters with ultra hard working surfaces is shown in FIGS. 1A and 1B. The drill bit 200 includes a bit body 210 having a threaded upper pin end 211 and a cutting end 215. The cutting end 214 typically includes a plurality of ribs or blades 220 arranged about the rotational axis L (also referred to as the longitudinal or central axis) of the drill bit and extending radially outward from the bit body 210. Cutting elements, or cutters, 250 are embedded in the blades 220 at predetermined angular orientations and radial locations relative to a working surface and with a desired back rake angle and side rake angle against a formation to be drilled.

A plurality of orifices 216 are positioned on the bit body 210 in the areas between the blades 220, which may be referred to as "gaps" or "fluid courses." The orifices 216 are commonly adapted to accept nozzles. The orifices 216 allow drilling fluid to be discharged through the bit in selected directions and at selected rates of flow between the blades 220 for lubricating and cooling the drill bit 200, the blades 220 and the cutters 250. The drilling fluid also cleans and removes the cuttings as the drill bit 200 rotates and penetrates the geological formation. Without proper flow characteristics, insufficient cooling of the cutters 250 may result in cutter failure during drilling operations. The fluid courses are positioned to provide additional flow channels for drilling fluid and to provide a passage for formation cuttings to travel past the drill bit 200 toward the surface of a wellbore (not shown).

Referring to FIG. 1B, a top view of a prior art PDC bit is shown. The cutting face 218 of the bit shown includes six blades 220-225. Each blade includes a plurality of cutting elements or cutters generally disposed radially from the center of cutting face 218 to generally form rows. Certain cutters, although at differing axial positions, may occupy radial positions that are in similar radial position to other cutters on other blades.

Cutters are conventionally attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to only a couple of alloys which offer low enough brazing temperatures to avoid damage to the diamond layer and high enough braze strength to retain cutting elements on drill bits.

A significant factor in determining the longevity of PDC cutters is the exposure of the cutter to heat. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal mis-match between diamond and catalyst discussed above. This is particularly true for cutters that are immovably attached to the drill bit, as conventional in the art.

Accordingly, there exists a continuing need to develop ways to extend the life of a cutting element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting structure that includes an outer support element; and an inner rotatable cutting element comprising a cutting face at its upper end; wherein the inner rotatable cutting element comprises at least one line contact along a circumferential side surface thereof and/or at least one point contact at a bottom face thereof.

In another aspect, embodiments disclosed herein relate to a downhole cutting tool that includes a cutting element support structure having at least one cutter pocket formed therein; at least one rotatable cutting element disposed within the at least one cutter pocket, where in the at least one rotatable cutting element comprises a cutting face at its upper end; at least one pin disposed adjacent an circumferential side surface of the at least one rotatable cutting element; and at least one retaining element configured to retain the rotatable cutting element in the cutter pocket.

In yet another aspect, embodiments disclosed herein relate to a downhole cutting tool that includes a cutting element support structure having at least one cutter pocket formed therein; at least one rotatable cutting element disposed within the at least one cutter pocket, where in the at least one rotatable cutting element comprises a cutting face at its upper end; at least one ball disposed adjacent bottom face of the at least one rotatable cutting element; and at least one retaining element configured to retain the rotatable cutting element in the cutter pocket Other aspects and advantages of the claimed subject matter will be apparent from the following description and the appended claims.

DETAILED DESCRIPTION

In one aspect, embodiments disclosed herein relate to polycrystalline diamond compact cutters having improved rolling efficiency, i.e., its ability to rotate freely and easily about its longitudinal axis. The cutting elements may be retained on a bit or tool in any manner such that it is free to rotate about its longitudinal axis. Improved rolling efficiency may be obtained by reducing the contact surface area between the rotatable cutting element and the cutter pocket or sleeve in which is free to rotate. Such reduction in contact surface area may be achieved by reducing the contact surface area along the circumferential side surface of the rotatable cutter and/or a bottom face of the rotatable cutter. Reduction in surface area may include at least one line contact along a circumferential side surface and/or at least one point contact at a bottom face.

Figure 2:
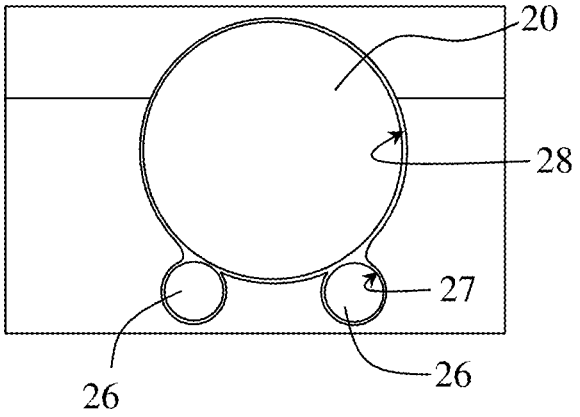
FIG. 2 shows a cross-sectional view of an embodiment of a cutting element.
Figure 3:
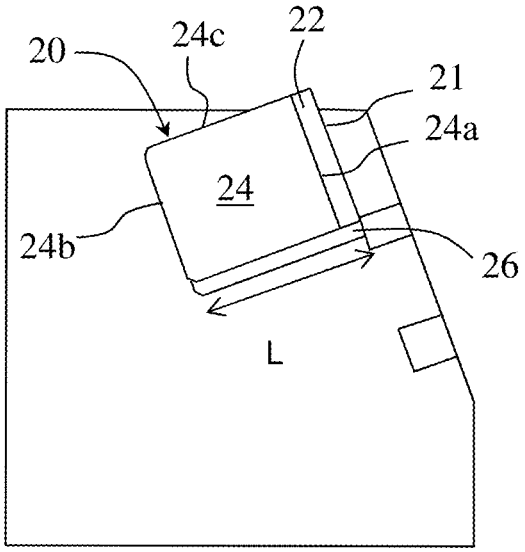
FIG. 3 shows a cross-sectional view of an embodiment of a cutting element.

FIGS. 2 and 3 illustrate two different cross-sectional views of a cutting element according to embodiments of the present disclosure. As shown in FIGS. 2 and 3, a cutting element 20 possesses an ultrahard material layer 22 and a substrate 24. Ultrahard material layer 22 is disposed on and interfaces with an upper surface 24*a* of substrate 24. While upper surface 24*a* is illustrated as being planar, it (and the interfacing ultrahard layer) may be non-planar to form any type of non-planar interface as known in the art. An upper surface 22*a* of ultrahard material layer 22 is shown as being substantially planar and is the cutting surface 21 of the cutting element 20 when installed on a bit or other cutting tool. However, according to other embodiments, the cutting surface of a cutting element may be non-planar. For example, a cutting surface may be curved such that a cross-sectional view of the cutting element shows the cutting surface as convex from the substrate portion of the cutting element. In other embodiments, surface alterations such as grooves may be formed in the cutting surface. The lowermost surface 24*b* of substrate is also shown as being substantially planar. A cylindrical side surface 24*c* extends the length of substrate 24 between upper surface 24*a* and lower surface 24*b*. In the embodiment illustrated in FIGS. 2 and 3, a plurality of roller pins 26 are embedded in a plurality of grooves 27 formed in the cutter pocket 28 and contact cylindrical side surface 24*c* of rotatable cutting element 20. Roller pins 26 may be set at the same exposure as the cutter pocket 28 or at a slightly higher exposure than the cutter pocket 28 to further reduce the contact surface of the rotatable cutting element 20 with the cutter pocket 28. Such exposure may be up to 4 mm, up to 3 mm, up to 2 mm, or up to 1 mm greater than the cutter pocket 28 (based on the smallest diameter portion of the cutter pocket 28). Further, depending on the size of the cutting element and tool, the size of the roller pins, the number, spacing, and placement of roller pins, this amount may vary. Because of the cylindrical nature of the rotatable cutting element and departure away from a substantially mating contact surface, the incorporation of roller pin(s) 26 along at least a portion of the circumferential side surface 24*c* allows for the contact surface between the rotatable cutting element 20 and the roller pin(s) 26 to be lines of contact formed by tangent points between the roller pin(s) 26 and the cylindrical rotatable cutting element 20.

Further, while the roller pins 26 are illustrated as extending along the entire length L of rotatable cutting element 20, it is also within the scope of the present disclosure that less than the entire length L be contacted by roller pins. For example, in one embodiment, at least 25 percent of the length L be contacted, at least 50 percent in another embodiment, and at least 75 percent in another embodiment. Further, it is also within the scope of the present disclosure that multiple separate "sets" of roller pins 26 may be used at different axial positions.

Figure 4:
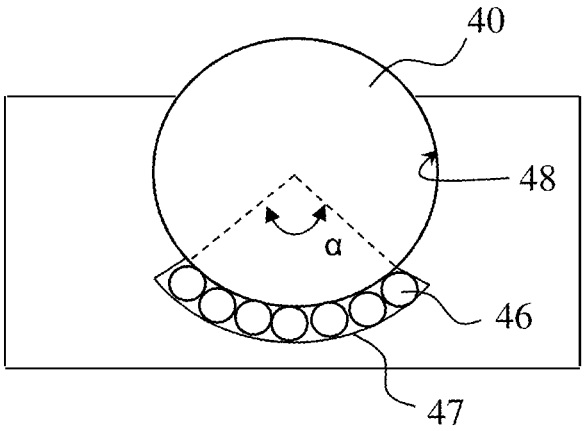
FIG. 4 shows a cross-sectional view of an embodiment of a cutting element.

Referring now to FIG. 4, a cross-sectional view of another embodiment of a cutting element is shown. As shown in FIG. 4, a plurality of roller pins 46 are embedded in a single groove 47 formed in the cutter pocket 48 and contact cylindrical side surface 44*c* of rotatable cutting element 40. Roller pins 46 may be set at the same exposure as the cutter pocket 48 or at a slightly higher exposure than the cutter pocket 48, as discussed with respect to FIGS. 2 and 3. The use of pins 46 along an arc of α degrees of circumferential side surface 44*c* allows for the contact surface between the rotatable cutting element 40 and the roller pins 46 to be lines of contact formed by tangent points between the roller pins 46 and the cylindrical rotatable cutting element 40 for the entire arc of α degrees. Alpha may range, for example, from 30 to 180 degrees, and from 45 to 120 degrees in more particular embodiments. In one or more embodiments, a may range from any of a lower limit of 15, 30, 45, 60, 75, 90, 105, or 120 degrees to any of an upper limit of 270, 225, 195, 180, 165, 150, 135, 120, 105, or 90 degrees. It is also within the scope of the present disclosure that greater or lesser arcs may be formed by the plurality of line contacts formed with the roller pins, or that even a single roller pin may be used. While the embodiment shown in FIG. 4 includes a single groove 47 in which the plurality of pins 46 are disposed to cover the entire extent of α degrees, it is also within the scope of the present disclosure that multiple grooves may be used, each containing multiple roller pins.

Figure 5:
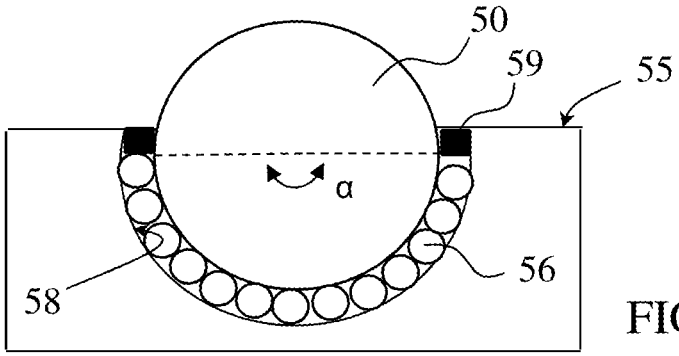
FIG. 5 shows a cross-sectional view of an embodiment of a cutting element.

While roller pins 46 are illustrated in FIG. 4 as being disposed in a groove or cavity 47 in cutter pocket 48, it is also within the scope of the present disclosure that no groove or cavity be included. For example, referring to FIG. 5, such embodiment is shown. As shown in FIG. 5, a plurality of roller pins 56 are disposed in the cutter pocket 58 and contact cylindrical side surface 54*c* of rotatable cutting element 50. As illustrated, pins 56 span an arc α of about 180 degrees of circumferential side surface 44*c* and are retained between the cutter pocket 58 and the rotatable cutting element 50 by stoppers 59 at the interface of the cutter pocket 58 and blade top 55.

Figure 6:
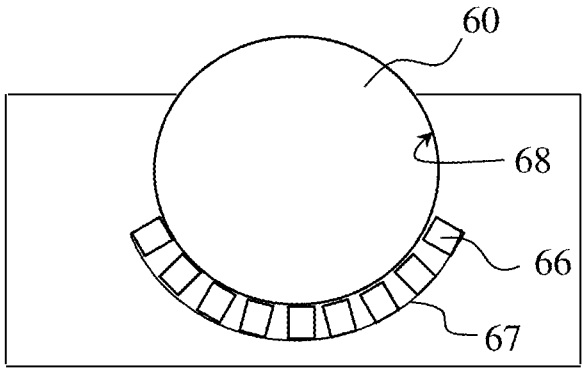
FIG. 6 shows a cross-sectional view of an embodiment of a cutting element.

The above illustrated embodiments all include cylindrical pins, which may be free to rotate about their own longitudinal axis; however, the present disclosure is not so limited. For example, roller pins may be cast, infiltrated, or brazed in place such that they are prohibited from rotating, or alternatively, non-cylindrical pins may be used. Referring now to FIG. 6, a plurality of block pins 66 are embedded in a single groove 67 formed in the cutter pocket 68 and contact cylindrical side surface 64*c* of rotatable cutting element 60. Roller pins 66 may be set at the same exposure as the cutter pocket 48 or at a slightly higher exposure than the cutter pocket 68, as discussed with respect to FIGS. 2 and 3. The use of block pins 66 along an arc of α degrees of circumferential side surface 64*c* allows for the contact surface between the rotatable cutting element 60 and the roller pins 66 to be lines of contact formed by tangent points between the planar surface of block pins 66 and the cylindrical rotatable cutting element 60 for the entire arc of α degrees, which may have exemplary ranges as discussed above.

Figure 7:
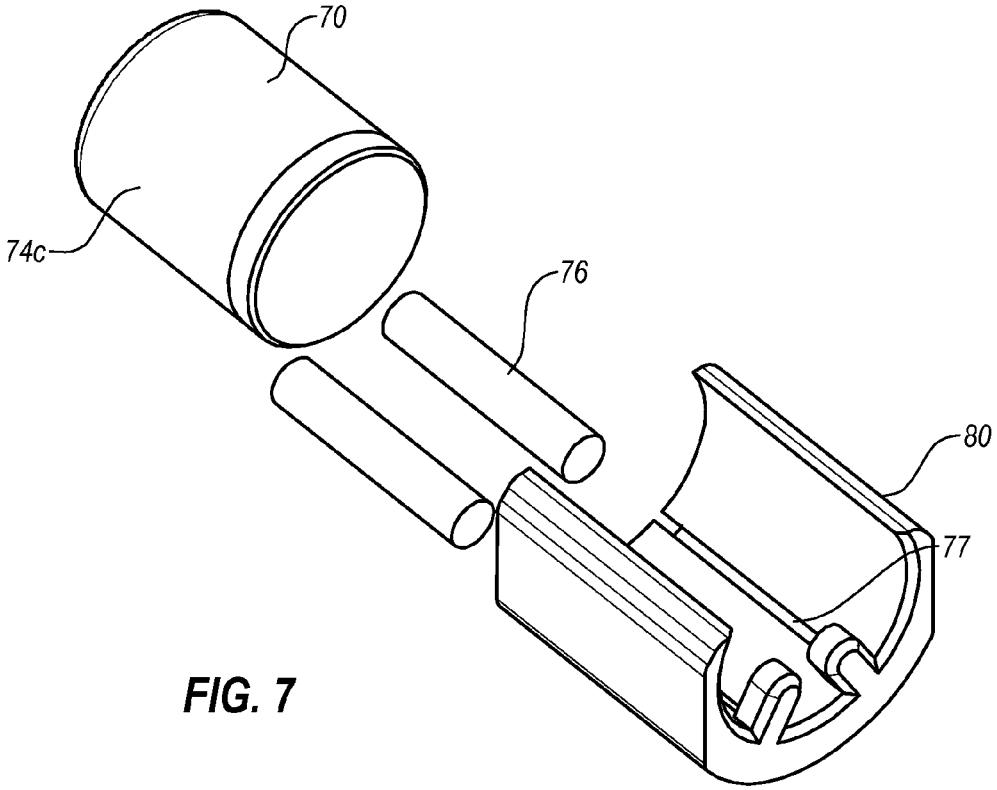
FIG. 7 shows a perspective view of an embodiment of a cutting element.
Figure 8:
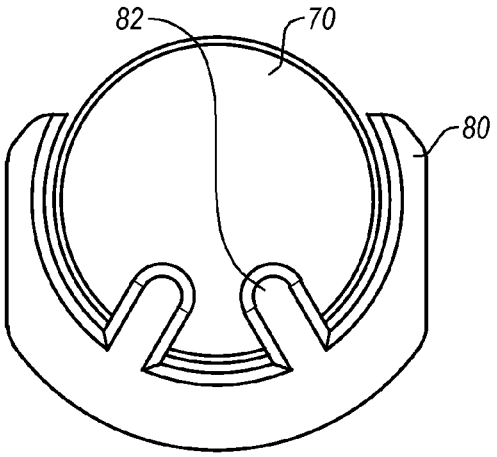
FIG. 8 shows an end view of an embodiment of a cutting element.
Figure 9:
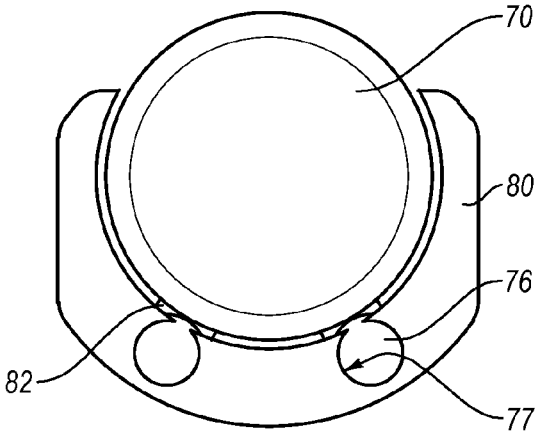
FIG. 9 shows an end view of an embodiment of a cutting element.

Additionally, while the above-discussed embodiment have illustrated roller or block pins being disposed between a cutter pocket and a rotatable cutting element, the present disclosure also applies to embodiments using a sleeve between the cutter pocket and the rotatable cutting element. Thus, in such a manner, the cutter assembly of the rotatable cutting element and the sleeve may include any of the embodiments discussed with respect to FIGS. 2 to 6. For illustrative purposes, FIGS. 7-9 and 14-18 show various embodiments of a rotatable cutting element disposed within a sleeve. Referring now to FIGS. 7-9, an exploded view and both end views of a cutter assembly are shown. As shown in FIGS. 7 to 9, a rotatable cutting element 70 may be placed in a sleeve 80, with roller pins 76 are embedded in a plurality of grooves 77 formed in the sleeve 80 and contact cylindrical side surface 74*c* of rotatable cutting element 70. Roller pins 76 may be set at the same exposure as the inner diameter of sleeve 80 or at a slightly higher exposure than the sleeve to further reduce the contact surface of the rotatable cutting element 70 with the sleeve 80, similar to as discussed with respect to FIGS. 2 and 3. Because of the cylindrical nature of the rotatable cutting element and departure away from a substantially mating contact surface, the incorporation of roller pin(s) 76 along at least a portion of the circumferential side surface 74*c* allows for the contact surface between the rotatable cutting element 70 and the roller pin(s)

Figure 18:
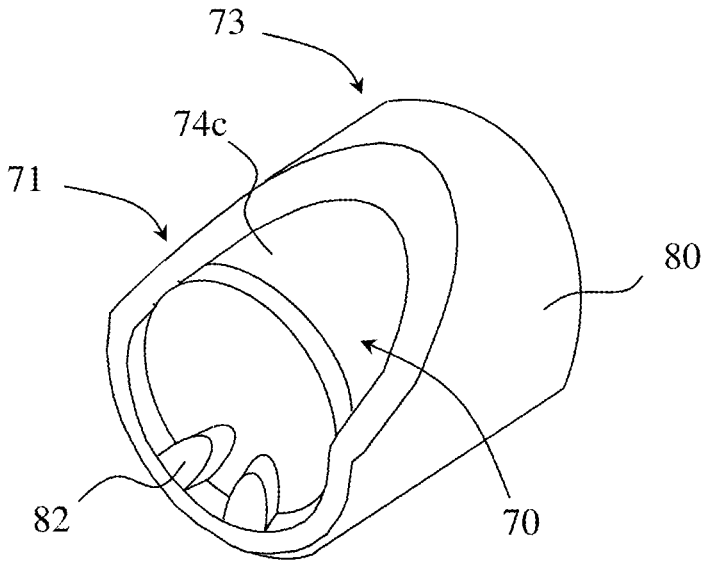
FIG. 18 shows a perspective view of a cutting element according to embodiments of the present disclosure.

76 to be lines of contact formed by tangent points between the roller pin(s) 76 and the cylindrical rotatable cutting element 70. Sleeve 80 may entirely surround the rotatable cutting element 70, such as shown in FIG. 18, or may partially surround it, as illustrated in FIGS. 7-9. In addition to surrounding at least a portion of cylindrical side surface 74*c* of rotatable cutting element 70, sleeve 80 may also optionally include front blocking mechanisms 82 that prevent rotatable cutting element 70 from axially sliding out of sleeve 80. Sleeve 80 may be brazed or otherwise retained in a cutter pocket (not shown) in a bit or other cutting tool.

FIG. 18 shows a rotatable cutting element 70 placed in a sleeve 80 that entirely surrounds the cylindrical side surface 74*c* of a portion of the rotatable cutting element 70. Particularly, the sleeve 80 partially surrounds the cylindrical side surface 74*c* of the cutting end portion 71 of the rotatable cutting element 70 and entirely surrounds the cylindrical side surface 74*c* of the portion 73 of the rotatable cutting element distal from the cutting end portion 71. The sleeve 80 may also optionally include front blocking mechanisms 82 that prevent rotatable cutting element 70 from axially sliding out of sleeve 80. Further, roller pins (not shown) are embedded in a plurality of grooves formed in the sleeve 80, such that the roller pins are disposed between the sleeve 80 and the rotatable cutting element 70 and contact cylindrical side surface 74*c* of rotatable cutting element 70.

Figure 15:
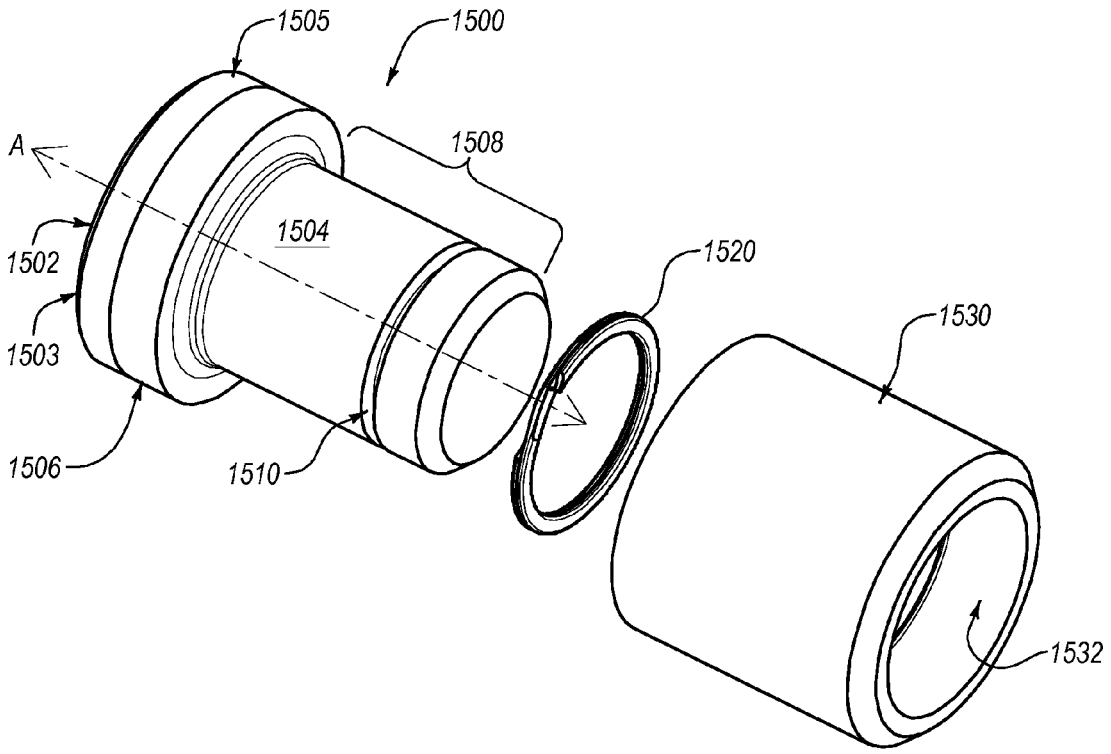
FIG. 15 shows a perspective view of a cutting element according to embodiments of the present disclosure.
Figure 16:
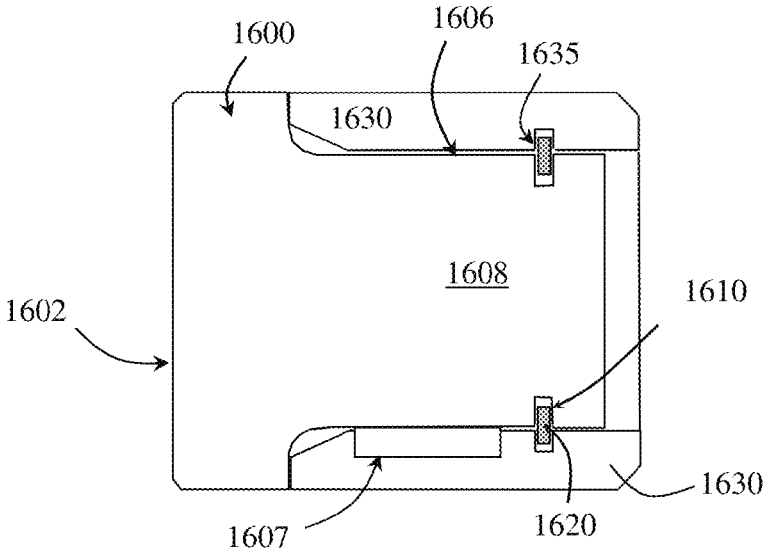
FIG. 16 shows a cross-sectional view of a cutting element according to embodiments of the present disclosure.
Figure 17:
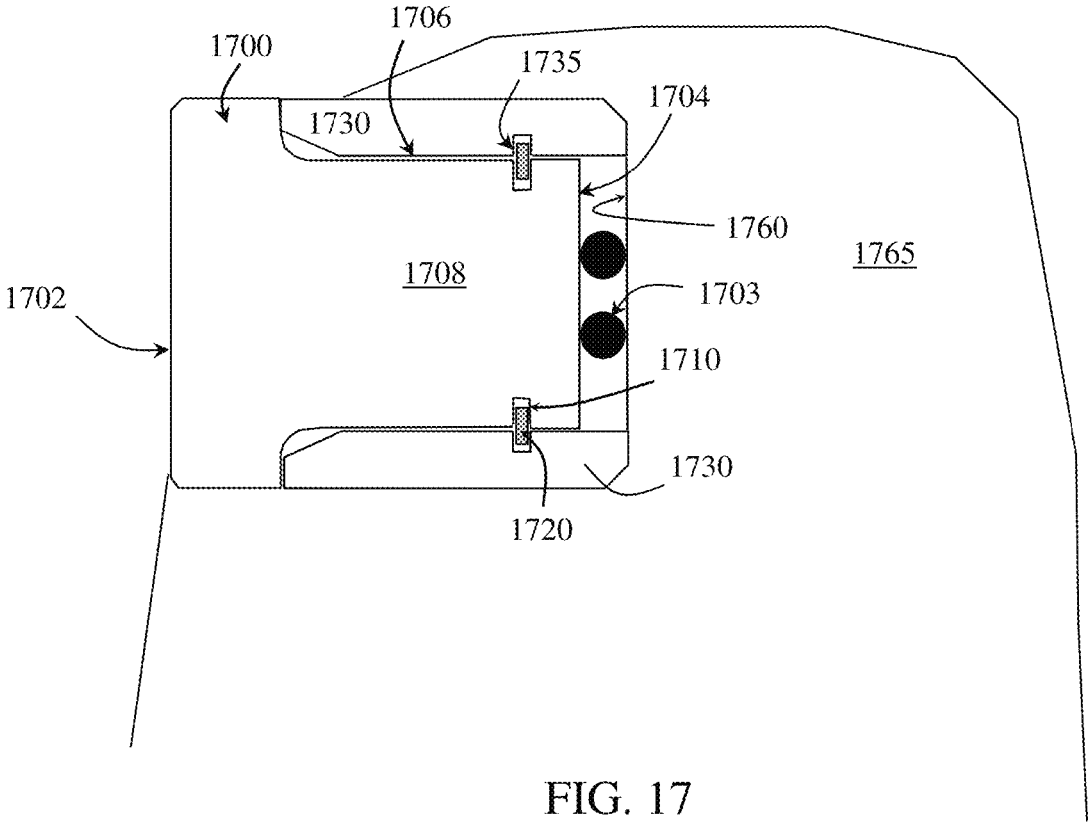
FIG. 17 shows a cross-sectional view of a cutting element according to embodiments of the present disclosure.

According to embodiments of the present disclosure, a sleeve may extend the entire length of the rotatable cutting element, or may extend a partial length of the rotatable cutting element. For example, FIGS. 15-17 show various embodiments of a rotatable cutting element disposed in a sleeve, wherein the sleeve extends a partial length of the rotatable cutting element. FIG. 15 shows an exploded view of a cutter assembly having a rotatable cutting element 1500 and a sleeve 1530. The rotatable cutting element 1500 has a cutting face 1502 and a body 1504 extending axially downward from the cutting face 1502 along an axis of rotation A. The body 1504 has an outer side surface 1506 and a shaft 1508. As shown, the shaft 1508 has a diameter smaller than the diameter of the cutting face 1502. The sleeve 1530 has at least one inner diameter substantially matching the diameter of the shaft 1508, such that the sleeve 1530 may fit around the shaft 1508 portion of the rotatable cutting element 1500. The sleeve 1530 may also have an outer diameter that is substantially equal to the diameter of the cutting face 1502 portion of the rotatable cutting element 1500, such that when assembled, the rotatable cutting element 1500 and sleeve 1530 form a cutter assembly having a substantially cylindrical shape. The rotatable cutting element 1500 may be axially retained within the sleeve 1530 using a retaining ring 1520. Particularly, the retaining ring 1520 may be disposed between a circumferential groove 1510 formed in the outer side surface 1506 of the shaft 1508 and a groove or cut-out formed in the inner surface 1532 of the sleeve 1530.

Referring now to FIG. 16, a cross-sectional view of a cutter assembly having a rotatable cutting element 1600 disposed within a sleeve 1630 extending a partial length of the rotatable cutting element 1600 is shown. As shown, the rotatable cutting element 1600 has a cutting face 1602 and a shaft 1608, wherein the shaft 1608 is disposed within the sleeve 1630. The rotatable cutting element 1600 is axially retained within the sleeve 1630 using a retaining ring 1620, wherein the retaining ring 1620 is disposed between a circumferential groove 1610 formed in the outer side surface 1606 of the shaft 1608 and a cut-out 1635 formed in the inner surface of the sleeve 1630. In the embodiment illustrated in FIG. 16, a plurality of roller pins 1607 are embedded in a plurality of grooves formed in the sleeve 1630 and contact the outer side surface 1606 of rotatable cutting element 1600. Roller pins 1607 may be set at the same exposure as the sleeve 1630 or at a slightly higher exposure than the sleeve 1630 to further reduce the contact surface of the rotatable cutting element 1600 with the sleeve 1630. Depending on the size of the cutting element and tool, the size of the roller pins, the number, spacing, and placement of roller pins may vary.

Figure 10:
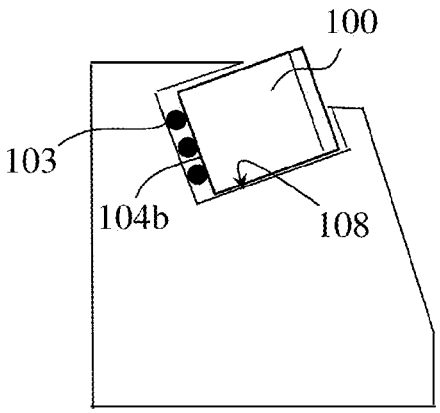
FIG. 10 shows a cross-sectional view of an embodiment of a cutting element.
Figure 11:
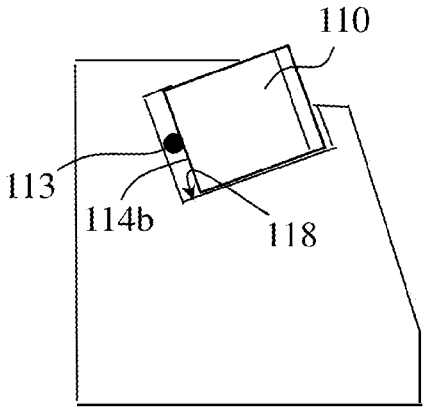
FIG. 11 shows a cross-sectional view of an embodiment of a cutting element.

While the above embodiments all illustrate variations on the plurality of line contacts that can be created along a rotatable cutting element's cylindrical side surface and a roller or block pin, the present disclosure also relates to the use of point contacts along a bottom face of the rotatable cutting element. As shown in FIG. 10, a plurality of balls 103 are disposed between a bottom face 104*b* of rotatable cutting element 100 and the back wall of cutter pocket 108 (or bottom portion of a sleeve). As shown in FIG. 11, a single ball 113 is disposed between a bottom face 114*b* of rotatable cutting element 100 and the back wall of cutter pocket 108. The embodiments in FIGS. 10 and 11 both include a planar bottom face 104*b*, 114*b* that interfaces ball(s) 103, 113 at a single point of contact for each ball, i.e., the bottom face 104*b*, 114*b* is tangent to the ball(s) 103, 113.

Figure 12:
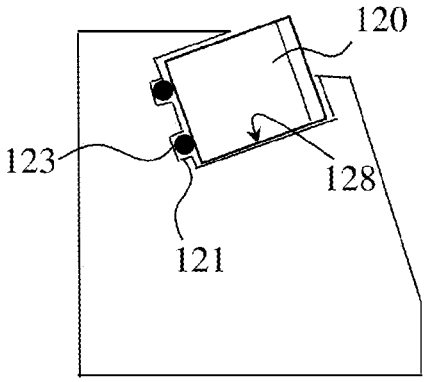
FIG. 12 shows a cross-sectional view of an embodiment of a cutting element.
Figure 13:
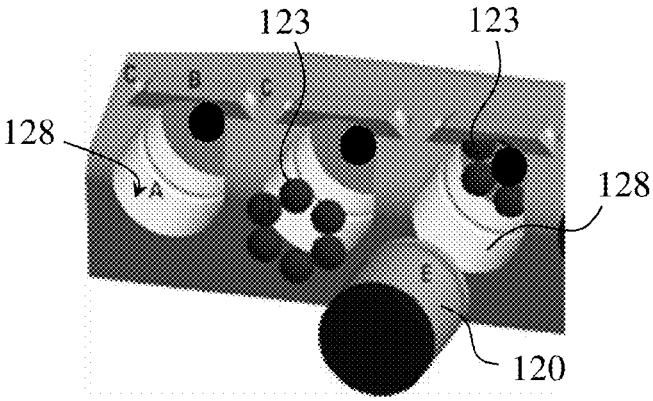
FIG. 13 shows a perspective view of an embodiment of a cutting element.

Referring now to FIGS. 12 and 13, a plurality of balls 123 are disposed between a bottom face 124*b* of rotatable cutting element 120 and the ball wall of cutter pocket 128 (or a bottom portion of a sleeve). In this embodiment, balls 123 sit within a groove or recess 121 formed in the back wall of cutter pocket 128. Balls 123 may sit within a groove or recess 121 so long as the balls 123 have a greater exposure height about the surrounding cutter pocket (or sleeve) material. Such exposure may be at least 1 mm, at least 2 mm, at least 3 mm, or at least 4 mm greater than the surrounding cutter pocket 128, for example. This may allow for the entire contact area for the bottom face 124*b* of the rotatable cutting element to be single point(s) of contact. However, it is also possible that the surrounding cutter pocket may be at the same exposure as the ball 123, but the contact surface area will be still be reduced by eliminating contact area at least for the radial extent of the ball(s).

In each of the embodiments shown above, the balls may be free to rotate about their own axis, and/or roll within the space between the rotatable cutting element and the cutter pocket. Further, while the embodiment shown in FIG. 13 is a circular groove around which the balls 123 may roll, it is also within the scope of the present disclosure that a groove, recess, or divot may be provided for each ball 123 to limit later movement but still allow for rotation about the ball axis. However, it is also within the present disclosure that the balls may be cast, infiltrated, brazed or otherwise fixed in place to limit lateral as well as rotational movement.

The pins and balls used in all of the above described embodiments may be formed from any wear resistant material, such as, for example, metal carbides, nitrides, or borides, polycrystalline diamond, thermally stable polycrystalline diamond (formed by either leaching or use of a SiC composite), or the like. Size of each may be determined by the size of the cutters, bits, etc. Further, while each of the above illustrated embodiments show a single size of pins and balls being used on with each rotatable cutting element, it is also within the scope of the present disclosure that multiple sizes of pins and/or balls may be used, where the smaller pins and/or balls may but do not always contact the rotatable cutting element but may used as spacers between larger adjacent pins and/or balls.

Figure 1A:
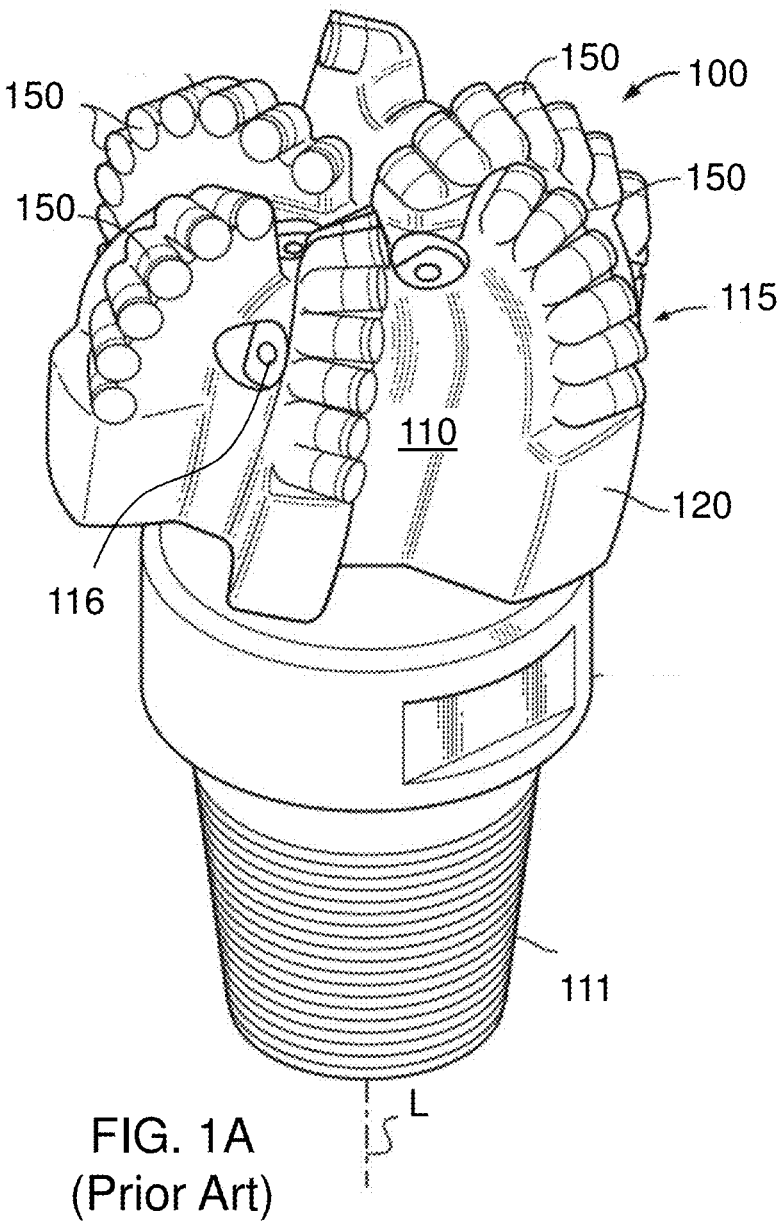
FIG. 1A (Prior Art)
FIGS. 1A and 1B show a side and top view of a conventional drag bit.
Figure 1B:
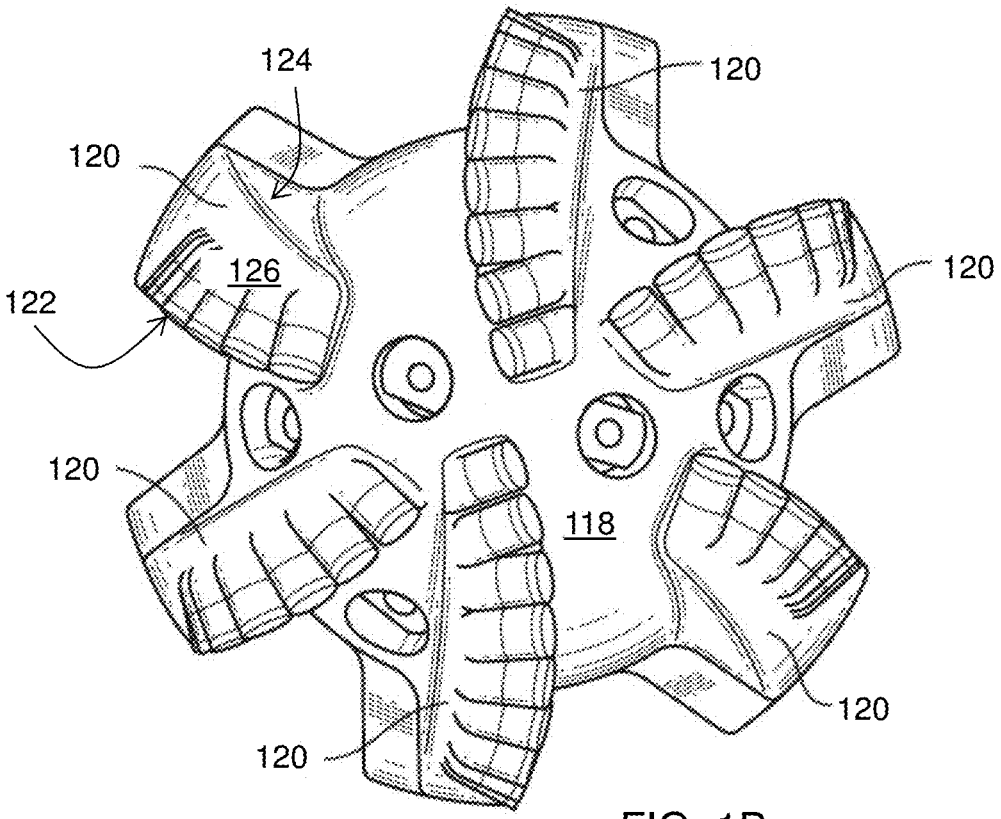
FIG. 1B (Prior Art)
Figure 14:
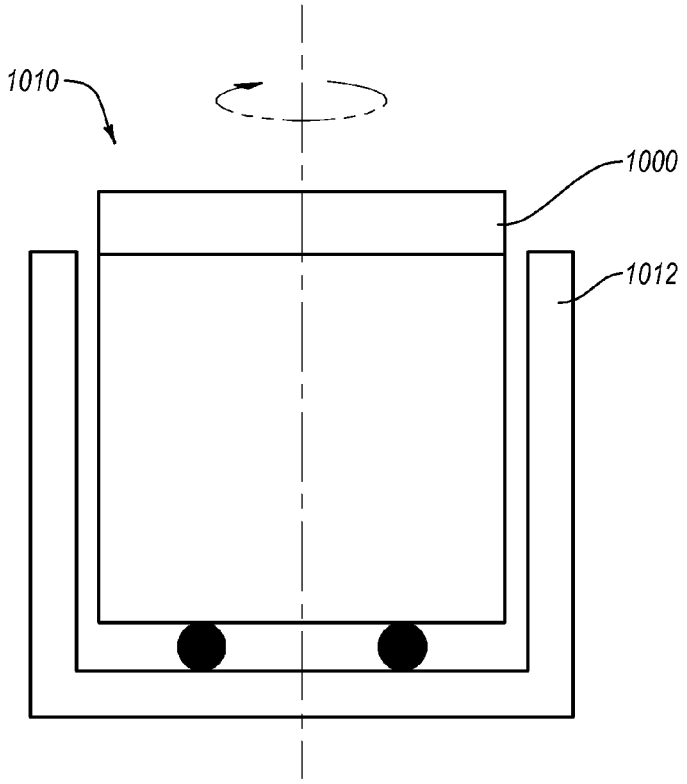
FIG. 14 shows a cross-sectional view of an embodiment of a cutting element.

Further, as described above, the various embodiment of cutting elements described herein may be used on a drill bit or other cutting tool, where the cutting elements are immovably attached to the drill bit or other cutting tool or where the cutting elements are retained on the drill bit (such as the type shown in FIGS. 1A and 1B above) or other cutting tool in such a manner that the cutting element is still capable of rotating about its longitudinal axis. For example, as shown in FIG. 14, a cutter assembly 1010 may include an inner rotatable cutting element 1000 partially surrounded by an outer support element 1012 and having balls or pins disposed therebetween as described in any one of FIGS. 2-13 above. The type of cutter assembly 1010 and outer support element 1012 is of no limitation to the present disclosure. Further, the type of cutter assembly is of no limitation to the present disclosure. Rather, it may be of any type and/or include any feature such as those described in U.S. Pat. No. 7,703,559, U.S. patent application Ser. Nos. 13/152,626, 61/479,183, 61/479,151, or 61/556,454, all of which are assigned to the present assignee and herein incorporated by reference in their entirety. For example, the outer support element 1012 may include components that at least partially cover the upper, side, and/or lower surfaces of the inner rotatable cutting element 1000.

In some embodiments, the outer support element 1012 may be integral with the cutting tool support structure (i.e., blade extending from a bit body) (not shown in FIG. 14); however, it may be a discrete component separate from the cutting tool support structure in yet other embodiments, such as a sleeve. One or more surfaces of balls, pins, and/or outer support element may be substantially mating with the inner rotatable cutting element, which to allow for sufficient room for rotation, may include a gap ranging from about 0.003 to 0.030 inches. However, this range may vary on one or more surfaces.

In embodiment using a discrete outer support element 1012 or sleeve, as illustrated in FIG. 14, such component may be placed by any means known in the art, including by casting in place during sintering the bit body (or other cutting tool) or by brazing the element in place in the cutter pocket (not shown). Brazing may occur before or after the inner rotatable cutting element 1000 is retained within the outer support element 1012; however, in particular embodiments, the inner rotatable cutting element 1000 is retained in the outer support element after the outer support element is brazed into place.

Referring now to FIG. 17, a cross-sectional view of a cutter assembly having a rotatable cutting element 1700 disposed within a sleeve 1730 extending a partial length of the rotatable cutting element 1700 is shown. The cuter assembly is disposed within a cutter pocket 1760 formed in a cutting tool 1765 (the cutting tool is not shown to scale with the cutter assembly). As shown, the rotatable cutting element 1700 has a cutting face 1702 and a shaft 1708, wherein the shaft 1708 is disposed within the sleeve 1730. The rotatable cutting element 1700 is axially retained within the sleeve 1730 using a retaining ring 1720, wherein the retaining ring 1720 is disposed between a circumferential groove 1710 formed in the outer side surface 1706 of the shaft 1708 and a cut-out 1735 formed in the inner surface of the sleeve 1730. The outer side surface 1706 extends the length of the rotatable cutting element 1700 between the cutting face 1702 and a bottom face 1704. A plurality of balls 1703 is disposed between the bottom face 1704 of the rotatable cutting element 1700 and the back wall of the cutter pocket 1760.

While inner rotatable cutting elements must be free to rotate about their longitudinal axis, their retention on a cutting tool may be achieved through the shape of the outer support element, generally, which may include one or more discrete components to achieve such retention. Certain components that may particularly provided such retention function may be separately referred to as a retention mechanism. The type of such retention mechanism is no limitation on the present disclosure, but may include retention by covering and/or interacting with an upper surface of the inner rotatable cutting element, a side surface of the inner rotatable cutting element, or a lower surface of the inner rotatable cutting element.

According to embodiments described herein, at least one ultrahard material may be included in the cutting elements. Such ultra hard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultra hard material such as a cubic boron nitride. Further, in particular embodiments, the inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that folins the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be preferable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The outer support element may be formed from a variety of materials. In one embodiment, the outer support element may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13 percent. It is also within the scope of the present disclosure that the outer support element (including a back retention mechanism) may also include more lubricious materials to reduce the coefficient of friction. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in US 2010/0108403, which is assigned to the present assignee and herein incorporated by reference in its entirety.

In other embodiments, the outer support element may be formed of alloy steels, nickel-based alloys, and cobalt-based alloys. One of ordinary skill in the art would also recognize that cutting element components may be coated with a hard-facing material for increased erosion protection. Such coatings may be applied by various techniques known in the art such as, for example, detonation gun (d-gun) and spray-and-fuse techniques.

The cutting elements of the present disclosure may be incorporated in various types of cutting tools, including for example, as cutters in fixed cutter bits or as inserts in roller cone bits. Bits having the cutting elements of the present disclosure may include a single rotatable cutting element with the remaining cutting elements being conventional cutting elements, all cutting elements being rotatable, or any combination therebetween of rotatable and conventional cutting elements.

In some embodiments, the placement of the cutting elements on the blade of a fixed cutter bit or cone of a roller cone bit may be selected such that the rotatable cutting elements are placed in areas experiencing the greatest wear. For example, in a particular embodiment, rotatable cutting elements may be placed on the shoulder or nose area of a fixed cutter bit. Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, etc, may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

A cutter may be positioned on a blade with a selected back rake to assist in removing drill cuttings and increasing rate of penetration. A cutter disposed on a drill bit with side rake may be forced forward in a radial and tangential direction when the bit rotates. In some embodiments because the radial direction may assist the movement of inner rotatable cutting element relative to outer support element, such rotation may allow greater drill cuttings removal and provide an improved rate of penetration. One of ordinary skill in the art will realize that any back rake and side rake combination may be used with the cutting elements of the present disclosure to enhance rotatability and/or improve drilling efficiency.

As a cutting element contacts formation, the rotating motion of the cutting element may be continuous or discontinuous. For example, when the cutting element is mounted with a determined side rake and/or back rake, the cutting force may be generally pointed in one direction. Providing a directional cutting force may allow the cutting element to have a continuous rotating motion, further enhancing drilling efficiency.

Embodiments of the present disclosure may provide at least one of the following advantages. By reducing the contact area between the rotatable cutter and the surrounding components, reduced friction and thus improved rolling efficiency may be achieved.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A cutting structure, comprising:

an outer support element located on a blade of a downhole tool; and an inner rotatable cutting element comprising a cutting surface at its upper end, the cutting surface comprising an ultrahard material, the cutting surface being rotatable about the inner rotatable cutting element axis;

wherein the inner rotatable cutting element comprises at least one line contact along a circumferential side surface thereof or a combination of at least one line contact along a circumferential side surface thereof and at least one point contact at a bottom face thereof, wherein the at least one line contact is between the inner rotatable cutting element and at least one pin that extends axially, and wherein the at least one pin is disposed in a groove in the outer support element.

2. The cutting structure of claim 1, further comprising a plurality of line contacts between the inner rotatable cutting element and a plurality of pins.

3. The cutting structure of claim 2, wherein the plurality of pins extend circumferentially around the inner rotatable cutting element by about 30 to 180 degrees.

4. The cutting structure of claim 3, wherein the plurality of pins extend circumferentially around the inner rotatable cutting element by about 45 to 120 degrees.

5. The cutting structure of claim 1, wherein the at least one pin has an exposure height of up to 4 mm greater than the outer support element.

6. The cutting structure of claim 1, wherein the at least one pin is formed of a carbide, boride, nitride, polycrystalline diamond, or thermally stable polycrystalline diamond.

7. The cutting structure of claim 1, wherein the at least one point contact is between the inner rotatable cutting element and at least one ball.

8. The cutting structure of claim 7, wherein the at least one ball is disposed in a groove formed in the outer support element.

9. The cutting structure of claim 7, wherein the at least one ball has an exposure height of at least 1 mm greater than the outer support element.

10. The cutting structure of claim 7, wherein the at least one ball is formed of a carbide, boride, nitride, polycrystalline diamond, or thermally stable polycrystalline diamond.

11. The cutting structure of claim 7, wherein the at least one ball is fixedly attached to the outer support element.

12. The cutting structure of claim 1, further comprising a plurality of point contacts between the inner rotatable cutting element and a plurality of balls.

13. The cutting structure of claim 1, wherein the at least one pin is a roller pin.

14. The cutting structure of claim 1, wherein the at least one pin is a block pin.

15. The cutting structure of claim 1, wherein the at least one pin is fixedly attached to the outer support element.

16. The cutting structure of claim 1, wherein the outer support element is a sleeve extending a partial length of the inner rotatable cutting element.

17. The cutting structure of claim 16, wherein a retaining ring is disposed within a circumferential groove formed around the circumferential side surface of the inner rotatable cutting element and a cut-out formed in an inner surface of the sleeve to axially retain the inner rotatable cutting element within the sleeve.

18. The cutting structure of claim 16, wherein the inner rotatable cutting element comprises a shaft disposed within the sleeve, wherein the diameter of the upper end of the inner rotatable cutting element is substantially equal to an outer diameter of the sleeve, and wherein the diameter of the shaft is substantially equal to an inner diameter of the sleeve.

19. The cutting structure of claim 1, wherein the cutting face is planar.

20. A downhole cutting tool, comprising:

a cutting element support structure on a blade having at least one cutter pocket formed therein;

at least one rotatable cutting element disposed within the at least one cutter pocket, where in the at least one rotatable cutting element comprises a cutting surface at its upper end, the cutting surface comprising an ultrahard material, the cutting surface being rotatable about the at least one rotatable cutting element axis;

at least one pin disposed in a groove in the cutting element support structure adjacent a circumferential side surface of the at least one rotatable cutting element, the at least one pin extending parallel to the axis of the at least one rotatable cutting element; and at least one retaining element configured to retain the rotatable cutting element in the cutter pocket.

21. The downhole cutting tool of claim 20, further comprising a sleeve at least partially surrounding the at least one rotatable cutting element, wherein the at least one pin is disposed between the sleeve and the at least one rotatable cutting element.

22. The downhole cutting tool of claim 20, wherein the at least one pin is disposed between the cutter pocket and the at least one rotatable cutting element.

23. A downhole cutting tool, comprising:

a cutting element support structure having at least one cutter pocket formed therein;

at least one rotatable cutting element disposed within the at least one cutter pocket, where in the at least one rotatable cutting element comprises a cutting surface at its upper end;

at least one ball disposed adjacent a planar bottom face of the at least one rotatable cutting element;

at least one retaining element configured to retain the rotatable cutting element in the cutter pocket; and a sleeve at least partially surrounding the at least one rotatable cutting element, wherein the at least one ball is disposed between the sleeve and the at least one rotatable cutting element.

24. The downhole cutting tool of claim 23, wherein the at least one ball is disposed between the cutter pocket and the at least one rotatable cutting element.

* * * * *